US006385950B1

(12) United States Patent
Anderson

(10) Patent No.: US 6,385,950 B1
(45) Date of Patent: May 14, 2002

(54) CARTON BOTTOM FOLDER

(75) Inventor: Paul Anderson, Addison, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/338,822

(22) Filed: Jun. 23, 1999

(51) Int. Cl.[7] ..... B65B 1/02; B31B 1/28

(52) U.S. Cl. ..... 53/563; 53/376.6; 53/452; 53/458; 53/565; 53/568; 493/164; 493/165; 493/454

(58) Field of Search ..... 53/563, 565, 564, 53/568, 456, 452, 458, 376.6; 493/164, 165, 454

(56) References Cited

U.S. PATENT DOCUMENTS 3,187,647 A * 6/1965 Braun ..... 93/44.1
3,398,659 A * 8/1968 Egleston ..... 93/44.1
4,589,862 A * 5/1986 Murrah ..... 493/183
5,538,491 A * 7/1996 Owen et al. ..... 493/184
5,681,253 A * 10/1997 Owen et al. ..... 493/183
6,056,918 A * 5/2000 Palaniappan et al. ..... 53/458
6,094,884 A * 8/2000 Christensen et al. ..... 53/375.9

FOREIGN PATENT DOCUMENTS

EP 0078294 * 2/1986 ..... B65B/49/12

* cited by examiner

*Primary Examiner*—Rinaldi I. Rada
*Assistant Examiner*—Chris Harmon
(74) *Attorney, Agent, or Firm*—Welsh & Katz, Ltd.

(57) ABSTRACT

A method and apparatus for forming the bottom of a carton on a form, fill and seal packaging machine such as the TETRA REX® packaging machine includes a sealing station for a bottom forming station that includes a pair of rotating spindles. Each spindle has a pre-folding member and a final folding member for infolding the bottom panels of the carton. The sealing station also includes a guide plate for guiding the final folded bottom panels of the carton to a sealing plate for permanent sealing. The bottom formed carton provides a tight seal, particularly for an over-folded carton, for use in packaging a product.

21 Claims, 7 Drawing Sheets

CARTON BOTTOM FOLDER

FIELD OF THE INVENTION

The present invention pertains to a folding device for carton bottoms. More particularly, this invention pertains to an apparatus for in-folding and sealing over-folded carton bottoms.

BACKGROUND OF THE INVENTION

A common form of container for milk, juice and the like is the gable top carton. In this regard, packaging technology has made enormous strides vis-à-vis these gable top cartons, as well as other types of packages. Present technology permits the packaging of perishable food items for non-refrigerated shelf lives that can be as much as 90 days. Such packages provide the ability to bring these food items into parts of the world that have limited transportation, distribution and storage infrastructure.

In an effort to continue to expand on the ability to extend the shelf life of perishable food items, various carton or package configurations have come into use. Some of these packaging configurations include extended shelf life ("ESL") packaging and aseptic packaging. Another known packaging configuration is the high acid ambient distribution ("HAAD") package, which also provides an enhanced shelf life. The HAAD package is configured for packaging materials, such as foodstuffs, that are relatively acidic (e.g., pH less than about 4.6), such as citrus juices.

In addition to the ever increasing shelf life demands for these perishable food items, the processing and packaging of the food items must also be carried out in a cost effective and efficient manner so that the packaged food items remain within the grasp of the purchasing public. To this end, the demands on packaging machines have become greater, in particular, relative to operating speeds. One type of packaging machine is referred to as a "form, fill and seal" machine, in which cartons or packages are constructed, filled and sealed in a sterile environment by a single machine. The operating speeds of some of these machines exceeds 10,000 packages per hour.

In order to maintain the integrity of the package after it is filled and sealed, advanced technologies have been applied to the carton materials, as well as the processing operations. Many such packaging materials are formed from paperboard or fiberboard-based materials formed in a composite structure. Typically, one or more layers, such as polymeric coatings, foil coatings and the like, are applied to the paperboard or fiberboard substrate to reduce or eliminate the gas and liquid permeability of the substrate material, and to accommodate relatively acidic contents, such as citrus based products.

When forming the carton or package, large stock material is typically cut into "blanks" that are used to form the carton. The stock material is folded or scored to a particular pattern, and the blank is folded along these score lines to form the carton. The various edges of the material are sealed or joined to one another to form the constructed carton. It has however, been observed that the edges of the material, where the material has been cut through the composite structure, can be susceptible to wicking of liquids from outside of the carton.

To this end a variety of carton bottom configurations have been used to overcome this wicking problem as well as other storage and/or distribution problems. One such bottom configuration is referred to as an over-folded bottom configuration. In this configuration, the carton bottom is formed from a plurality of panels, at least some of which are folded over themselves and other panels and are sealed to one another to form the sealed carton bottom.

Accordingly, there exists a need for a carton bottom folding device for folding and sealing over-folded carton bottoms, which device can be used with known form, fill and seal machines. Desirably, such a folding device can accommodate carton folding operations at the operating speeds of known filling machines. Most desirably, the folding device provides a tight, high-confidence bottom seal for paperboard and fiberboard based cartons for the storage of food items and the like.

SUMMARY OF THE INVENTION

A bottom forming apparatus is adapted for use in a packaging machine to form and seal a bottom of a carton of a series of cartons being processed on the packaging machine. The cartons each including a plurality of carton bottom panels configured for infolding and sealing to form the sealed carton bottom.

The bottom forming apparatus includes a mandrel turret having a plurality of mandrels projecting outwardly therefrom. The mandrel turret rotates about a fixed axis. A sealing station is disposed at a fixed position relative to the rotation of the mandrel turret. The sealing station receives each of the mandrels having a carton thereon. The sealing station includes a guide plate and first and second rotatable spindles. The spindles each have a pre-folding member and a final folding member extending therefrom.

A carton is advanced to the sealing station with the plurality of bottom panels substantially unfolded. As the spindles rotate, the pre-folding members and final folding members engage the plurality of carton bottom panels and fold the bottom panels inwardly to urge the panels into a folded condition. In a preferred embodiment, the guide plate is disposed to engage the bottom of a carton subsequent to folding by the final folding members to further urge the panels into the folded condition.

In a current embodiment, the pre-folding members are elongated rods projecting from their respective spindles and the final folding members are elongated rods projecting from their respective spindles, each at a predetermined angle relative to its respective pre-folding member. Preferably, the final folding members are formed having arcuate surfaces that engage the carton bottom panels.

The guide plate can be formed having an angled portion and a substantially flat portion, with the angled portion being proximal to the carton coming into engagement therewith.

To provide a seal for the carton bottom, a sealing plate is disposed subsequent to the guide plate and a mandrel plate is disposed on each of the mandrels. The plurality of folded carton bottom panels are compressed between the sealing plate and the mandrel plate to effect the carton bottom panel seal. The apparatus can include a heating station disposed prior to the sealing station relative to the rotation of the mandrel turret. The apparatus can also include a discharge station disposed subsequent to the sealing station for discharging the bottom sealed cartons, and an infeed station disposed prior to the heating station relative to the rotation of the mandrel turret for feeding the cartons onto the mandrels of the mandrel turret.

In a preferred embodiment, each mandrel plate has a plurality of flat surface areas and a plurality of recess areas, and the sealing plate has a plurality of projecting areas that correspond to the recess areas of the mandrel plates. The sealing plate engages each of the mandrel plates, with the folded bottom panels therebetween, during forming of the bottom of the carton.

A packaging machine for forming, filling and sealing a series of cartons includes a mandrel turret and a bottom forming station for forming the sealed carton bottoms. The packaging machine further includes a filling station disposed subsequent to the bottom forming station and a top sealing station disposed subsequent to the filling station. The packaging machine can further include a sterilization station disposed prior to the filling station. The packaging machine can be configured to produce a high acid ambient distribution product.

A method for forming a sealed bottom of a carton on a packaging machine includes the steps of placing an erected carton on a mandrel of a mandrel turret that rotates about a fixed axis. The carton has a plurality of substantially unfolded carton bottom panels that are pre-folded at a sealing station to form a plurality of pre-folded bottom panels. The pre-folded bottom panels are final folded after the pre-folding step, at the sealing station, to form a plurality of final folded carton bottom panels. The final folded carton bottom panels are guided to a sealing plate at the sealing station and are sealed to form the sealed carton bottom.

The method can include the step of heating the bottom panels at a heating station prior to the step of pre-folding the plurality of carton bottom panels. The pre-folding step can include rotating a pair of spindles each spindle having a pre-folding member into engagement with the carton bottom panels, and the final folding step can include rotating the pair of spindles, each spindle having a final folding member, into engagement with the carton bottom panels. The mandrel turret can be rotated about the fixed axis during the pre-folding and final folding steps.

Other features and advantages of the present invention will be apparent from the following detailed description, the accompanying drawings, and the appended claims.

DETAILED DESCRIPTION OF THE PREFERRED EMBODIMENTS

Figure 1:
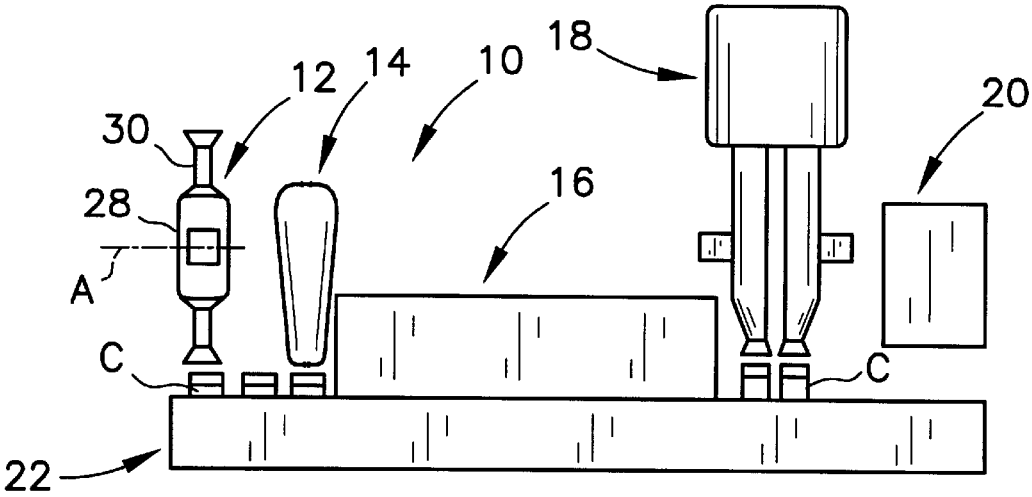
FIG. 1 is a side view illustration of a packaging machine including a bottom forming apparatus embodying the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures, and in particular to FIG. 1, there is shown a packaging machine 10 that includes a bottom forming station 12 in accordance with the principles of the present invention. The packaging machine 10 illustrated includes an optional fitment application station 14, a sterilization station 16, a filling station 18, a top sealing station 20 and a conveyor 22 for transporting a series of cartons C to and through each of the stations 12–20. Carton blanks B are received at the bottom forming station 12 and are processed through the machine 10 to produce a formed, filled and sealed carton C.

At the bottom forming station 12, the bottom M of the carton C is heated, folded and sealed to produce an open-top carton C with side walls 2*a*–*d* and a sealed bottom M. The open top carton C is placed on the conveyor 22 for transport at a predetermined rate, and moves in an indexed manner toward the right as viewed from the perspective of the machine 10 illustrated in FIG. 1. The cartons C are typically disposed equidistantly from one another and advance a predetermined number of carton positions during each periodic advancing step (e.g., indexing) of the conveyor 22.

Between each advancing step of the conveyor 22, the cartons C generally remain stationary for processing for a predetermined period of time. This predetermined period of time generally corresponds to the slowest process on the line in the fabrication of the carton C. The slowest process is generally the sealing of the top of the carton C after the carton C is filled with a desired product. A carton C will await the predetermined period of time, and then proceed, in the indexed manner, on to the next station.

Figure 2:
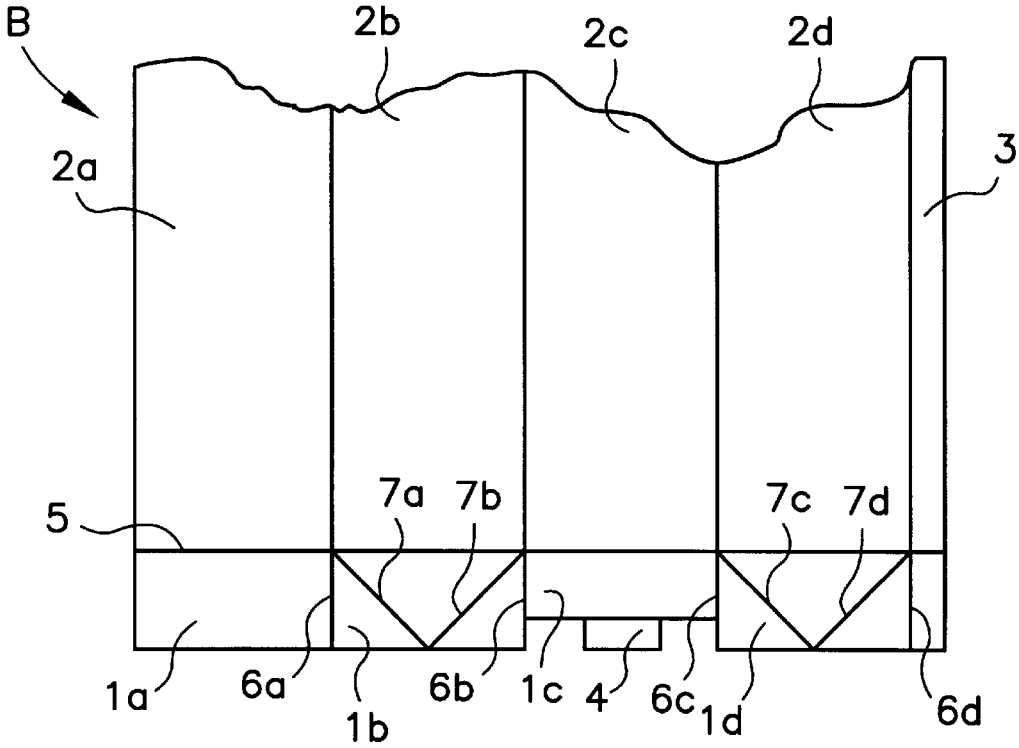
FIG. 2 is a partial plan view of the bottom portion of an overfolded carton blank.

FIG. 2 illustrates, generally, the lower portion of a carton blank B that is configured for forming an overfolded bottom M. The blank B has a plurality of bottom panels 1*a*–*d*, a plurality of side panels 2*a–d*, a sealing panel 3 and a sixth panel 4. Each of the bottom panels 1-*d* is partitioned from a corresponding side panel 2*a–d* by a horizontal score line 5. Each of the bottom panels 1*a–d* is partitioned from adjacent bottom panels by vertical score lines 6*a–d* (with vertical score line 6*d* partitioning bottom panel 1*d* from the sealing panel 3). The bottom panels 1*b* and 1*d* each have diagonal score lines 7*a,b* and 7*c,d,* respectively, for folding the bottom panels 1*b* and 1*d* inward during the bottom forming process. The sixth panel 4 is partitioned from bottom panel 1*c* by a horizontal score line 8.

Although an overfolded carton blank B is illustrated, those skilled in the art will recognized that other carton blanks, including traditional TETRA REX® and PURE PAK® carton blanks, may be used with the present invention without departing from the scope and spirit of the present invention. In those instances where the carton blank is for a HAAD product, the film structure of the carton blank may have an aluminum barrier layer.

Figure 3:
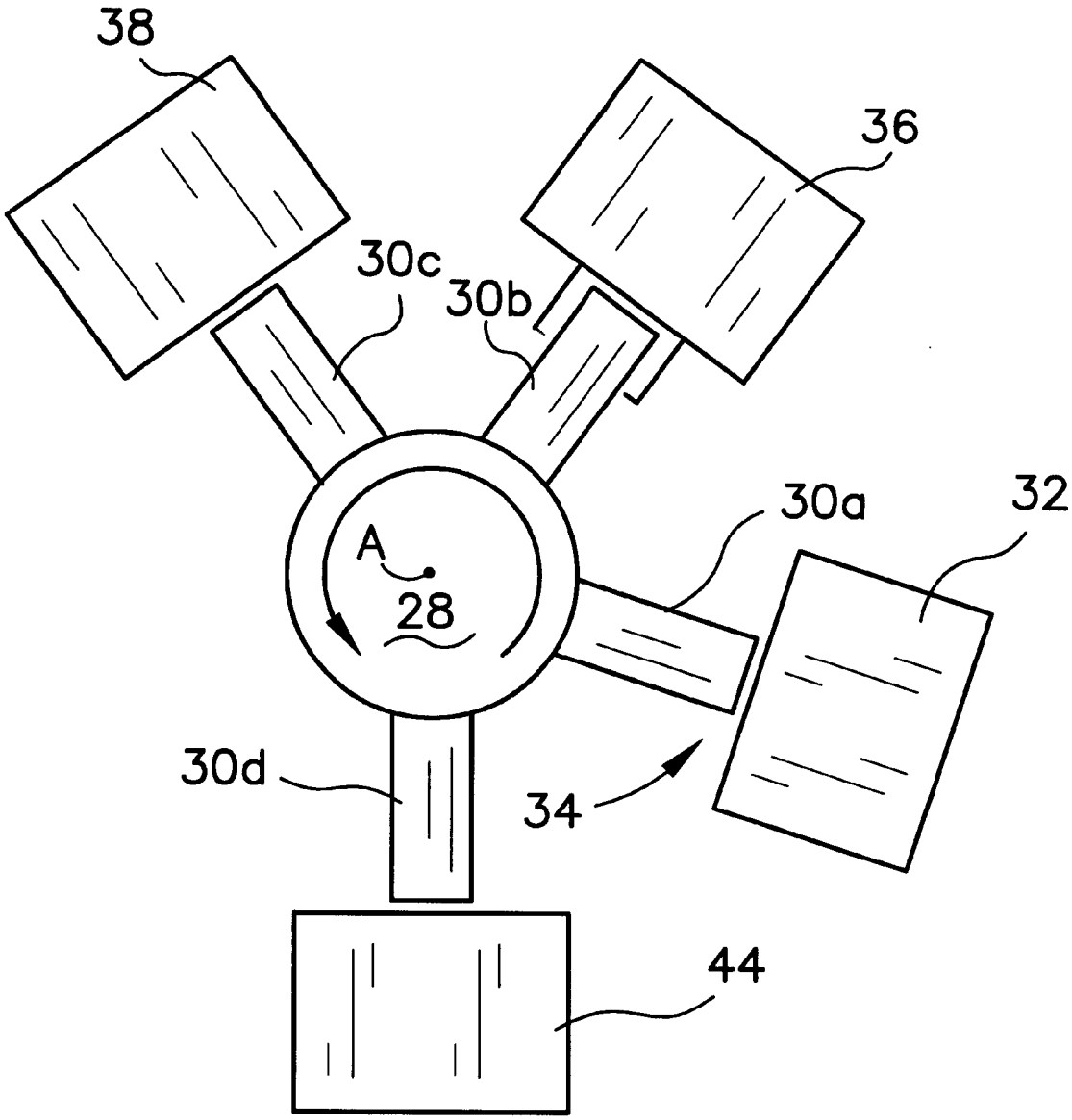
FIG. 3 is an isolated schematic view of the bottom forming apparatus of the present invention.

As shown in FIG. 3, the bottom forming station 12 includes generally, a mandrel turret 28 with mandrels 30*a–d* projecting therefrom. The mandrel turret 28 rotates about a fixed axis A to rotate each of the mandrels 30*a–d* to sub-processing stations disposed about the mandrel turret 28.

A magazine 32 stores a plurality of carton blanks B and feeds erected carton blanks B individually to a mandrel 30*a–d* at an infeed station 34. The erected carton blanks B have the bottom panels 1*a–d* projecting outwardly from the mandrel 30*a–d* in order to fold, heat and seal the bottom panels 1*a–d* together to form the bottom M of the carton C.

The next sub-processing station is the heating station 36, in which the bottom panels 1*a–d* are heated for sealing. The bottom panels 1*a–d* are heated to a temperature that is about equal to the melting point of a thermoplastic coating that is formed on the carton blank B. Typically, the coating is a low density polyethylene.

The next station is the sealing station 38, in which the bottom panels 1*a–d* are sealed to one another. The sealing station 38 is provided with the novel folding mechanism 40 of the present invention, which along with the sealing plate 42, facilitates forming a tight seal on each carton C that is processed at the bottom forming station 12. The folding mechanism 40 and sealing plate 42 will be described in more detail below.

The final sub-processing station on the bottom forming station 12 is the discharge station 44, in which the carton C, with it newly sealed bottom M, is discharged to the conveyor 22 for further processing on the packaging machine 10. Although the bottom forming station 12 is illustrated with a mandrel turret 28 having four mandrels 30*a–d* projecting therefrom, those skilled in the art will recognize that a mandrel turret with a greater or lesser number of mandrels is within the scope and spirit of the present invention.

Figure 4:
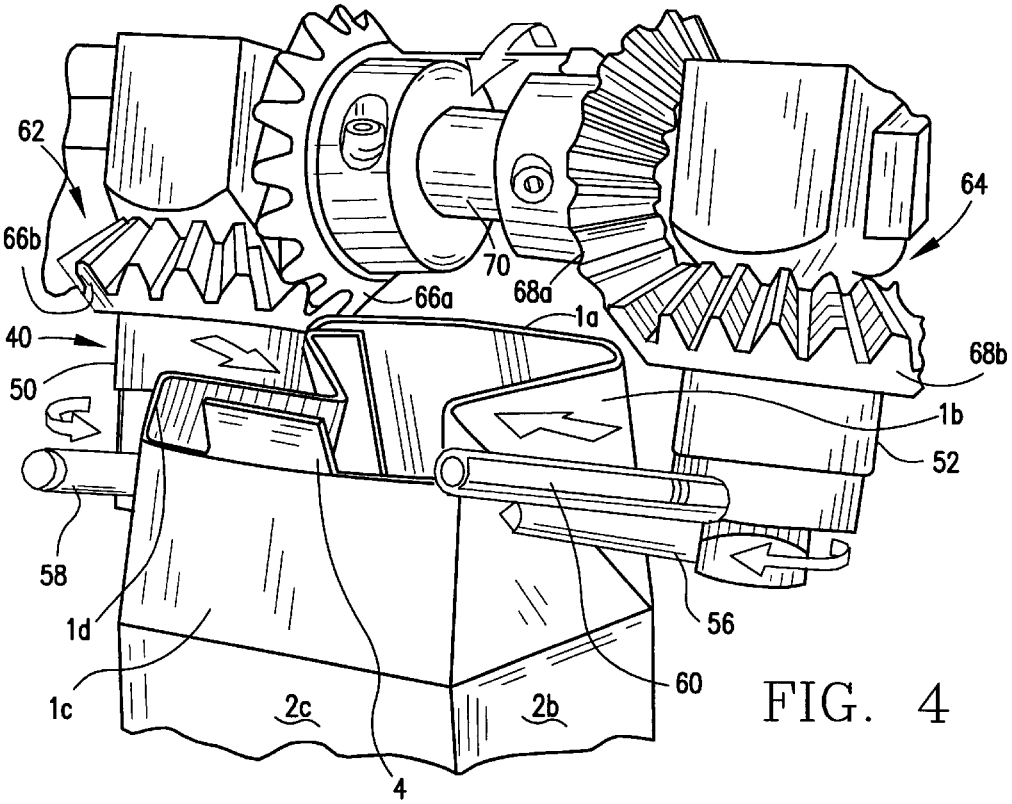
FIG. 4 is an enlarged fragmentary perspective view of the bottom forming apparatus of the present invention, the apparatus illustrated with a carton bottom/side panels being prefolded by the folding mechanism.
Figure 5:
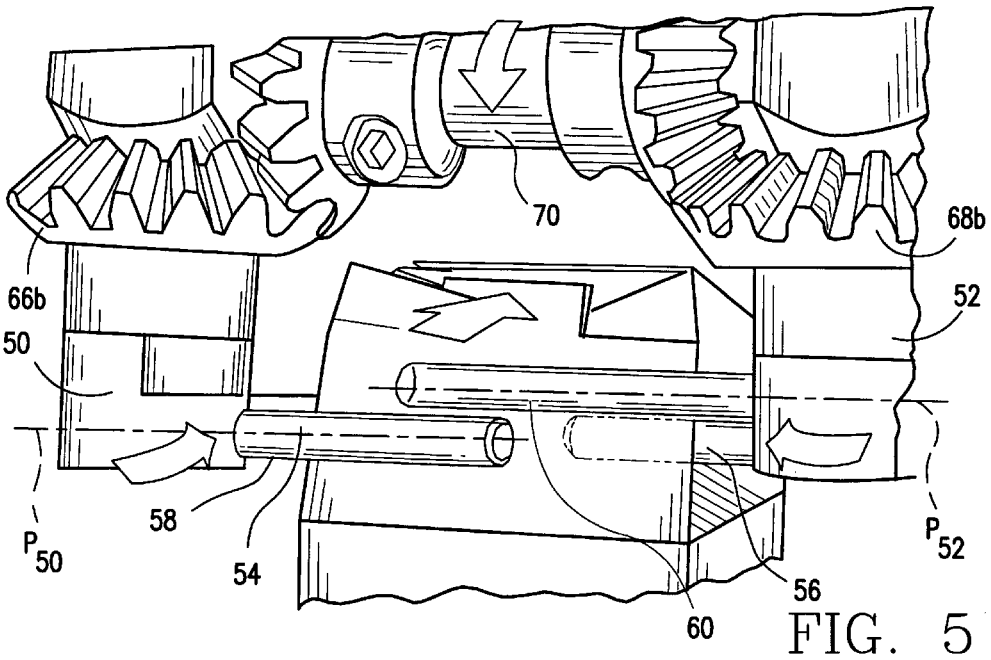
FIG. 5 is an enlarged fragmentary perspective view similar to FIG. 4 illustrating a later point in time, in which the carton bottom/side panels have been infolded and in which the carton bottom front and rear panels are being infolded by the folding mechanism.
Figure 8:
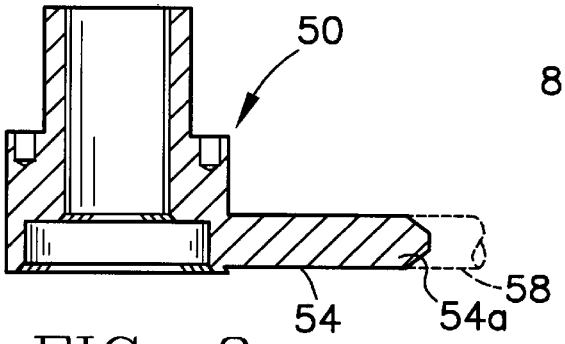
FIG. 8 is a cross-sectional view of the spindle of FIG. 6 taken along line 8—8 of FIG. 6.
Figure 6:
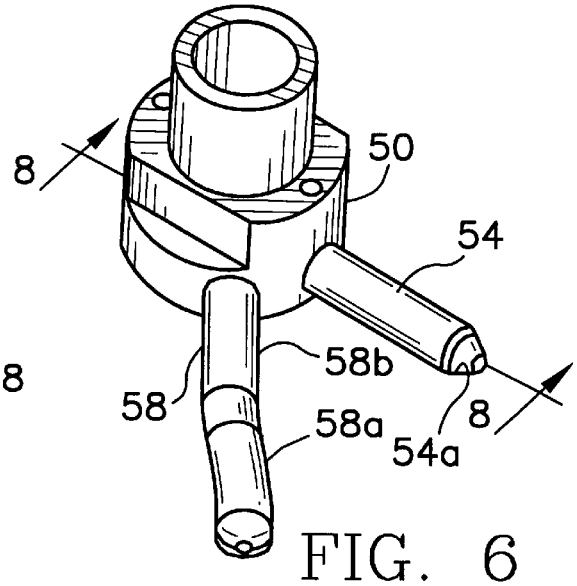
FIG. 6 is a perspective view of one of the folding member spindles of the folding mechanism.
Figure 7:
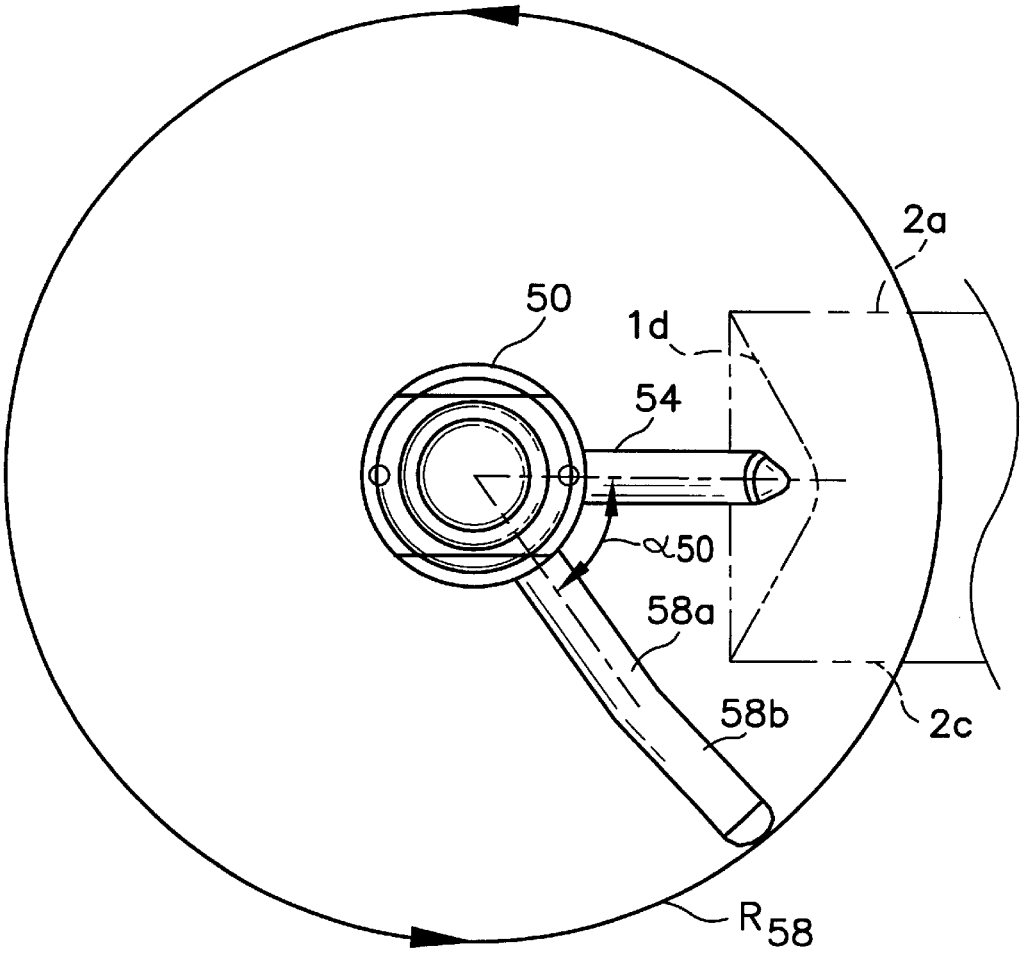
FIG. 7 is a schematic illustration of the folding member spindle of FIG. 6 as it is rotated into contact with the carton bottom panels, the figure being illustrated with a carton shown in phantom lines.
Figure 9:
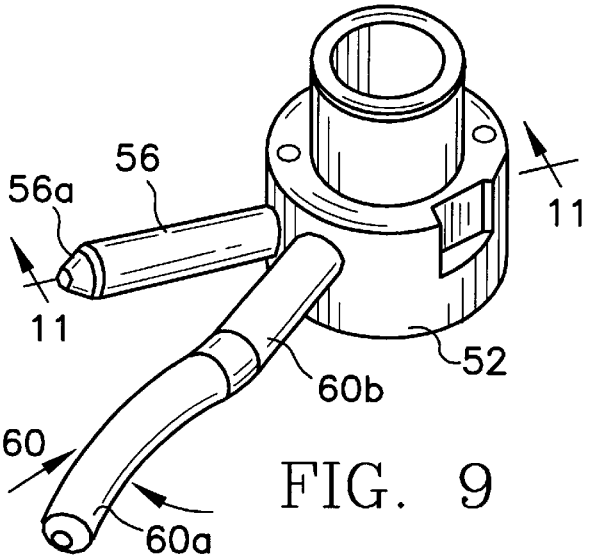
FIG. 9 is a perspective view similar to FIG. 6 illustrating the other of the folding member spindles of the folding mechanism.
Figure 11:
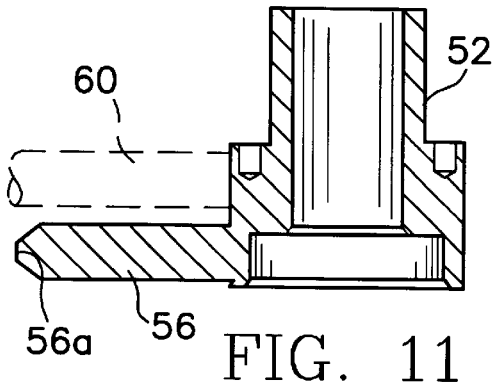
FIG. 11 is a cross-sectional view of the spindle of FIG. 9 taken along line 11—11 of FIG. 9.
Figure 10:
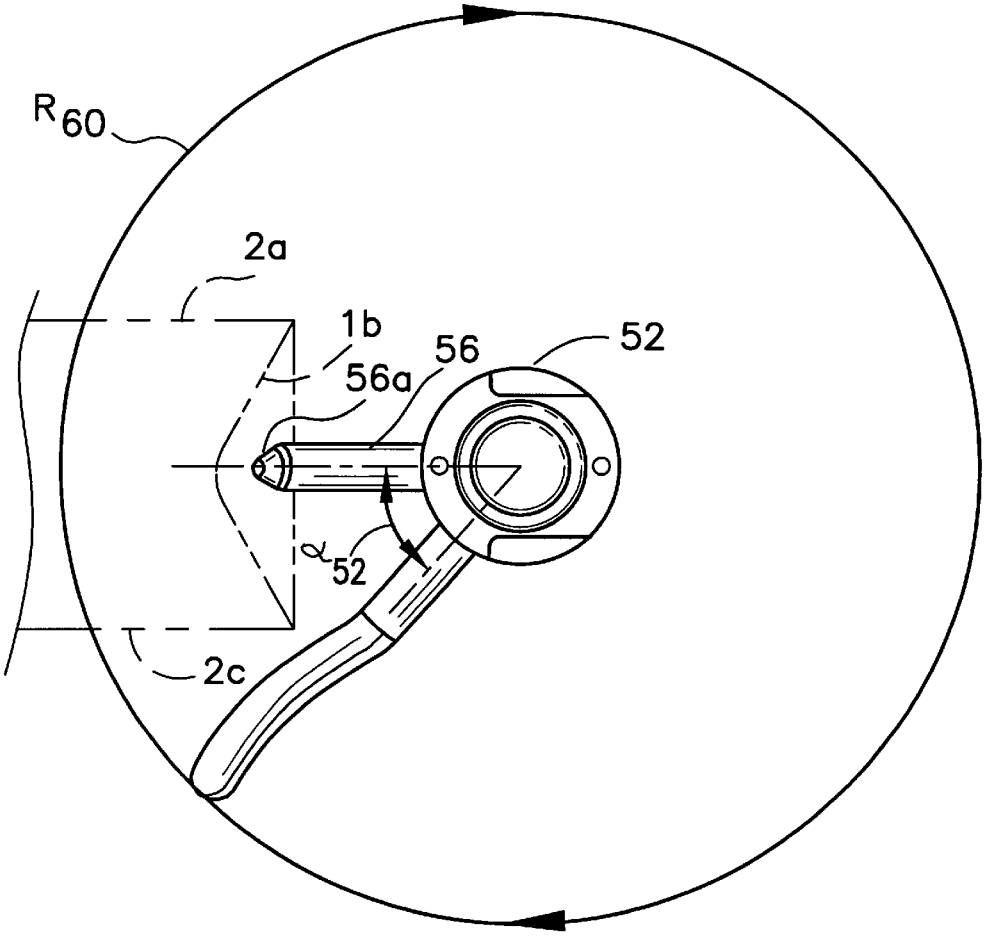
FIG. 10 is a schematic illustration similar to FIG. 7 illustrating the other folding member spindle (the spindle of FIG. 9) as it is rotated into contact with the carton bottom panels, the figure being illustrated with a carton shown in phantom lines.

FIGS. 4–5 illustrate the folding of the bottom panels 1*a–d* at the sealing station 38. The bottom panels 1*a–d* are folded as the carton C is rotated on the mandrel 28 toward the sealing plate 42. The folding mechanism, which is shown generally at 40, includes first and second rotating spindles 50, 52 that are respectively positioned to the sides of a carton C as it is rotated about the turret 28. Each spindle 50, 52 has a pre-folding member 54, 56 and a final folding member 58, 60 and rotates so as to bring the prefolding and final folding members 54–60 into contact with the rotating carton C.

Each pre-folding member 54, 56 is positioned at a predetermined angle $\alpha_{50}$, $\alpha_{52}$ relative to its respective final folding member 58, 60. The angles $\alpha_{50}$, $\alpha_{52}$ can of course vary depending on, for example, the particular carton C and the speed of rotation of the mandrel turret 28. In a current embodiment, the angle $\alpha_{50}$ between pre-folding member 54 and final folding member 58 of spindle 50 is about 53 degrees, and the angle $\alpha_{52}$ between pre-folding 56 member and final folding member 60 of spindle 52 is about 48 degrees.

In a preferred embodiment, pre-folding members 54, 56 and final folding members 58, 60 are stainless steel. The length of the members 54–60 can vary dependent upon, for example, the size of carton C; however, the members have a length at least adequate to fold the bottom panels 1*a–d* as set forth below. As will be apparent from FIG. 5, the spindles 50, 52 are spaced from one another so that the final folding members 58, 60 overlap each others' rotational path $R_{58}$, $R_{60}$. This overlapping of the rotational paths $R_{58}$, $R_{60}$ provides assurance the panels 1*a–d* are fully folded prior to advancing to the next station.

In order to prevent contact between the rotating final folding members 58, 60, the rotational paths $R_{58}$, $R_{60}$ of the members 58, 60 define planes $P_{58}$, $P_{60}$ that are substantially parallel to and spaced from one another. That is, the members 58,60 rotate at different heights relative to each other. In addition, the timing and position of rotation of the members 58, 60 is such that an upper or leading member 60 (that is, the member 60 that travels in a plane closer to the carton bottom M) leads the lower or trailing member 58. In this manner, the upper or leading member 60 first contacts panel 1*d*, and the lower or trailing member 58 contacts panel 1*b* later, albeit minimally, in time.

Referring to FIGS. 6–11, in a preferred embodiment, the final folding members 58, 60 each include a generally straight portion 58*a*, 60*a* proximal to their respective spindle 50, 52 connection, and a curved or arcuate portion 58*b*, 60*b*. The curved portions 58*b*, 60*b* are positioned so that an outer portion of each of the curves 58*b*, 60*b* engages bottom panel 1*c* as the members 58, 60 come into contact with the panel 1*c*. This configuration provides a rolling-like contact of the members 58, 60 with the panel 1*c*, so as to maintain contact between the members 58, 60 and the panel 1*c* along a length of the members 58, 60. In this embodiment, the pre-folding arms 54, 56 have a relatively straight profile, and are configured so that the end 54*a*, 56*a* each of the pre-folding arms 54, 56 first contacts their respective panels 1*d*, 1*b* to infold the panels.

As seen in FIGS. 4–5, each of the spindles 50, 52 has a drive assembly 62, 64 associated therewith. In a present embodiment, the drive assembly 62, 64 for each spindle 50, 52 includes a pair of crown gears 66*a,b* and 68*a,b* that engage one another. The spindle drive assemblies 62, 64 can be linked to one another to maintain proper relative rotational timing. In one embodiment in which the spindles 50, 52 are linked, one of each pair of crown gears 66*a*, 68*a* is operably connected to a main drive member, such as a drive shaft 70, which provides motive force for the folding mechanism 40. While the presently illustrated drive assemblies 62, 64 include pairs of crown gears 66, 68, it will be recognized by those skilled in the art that other drive arrangements, such as direct servo-drives and the like, can be used to provide motive force for rotating the spindles 50, 52, which other drive arrangements are within the scope of the present invention.

Figure 12:
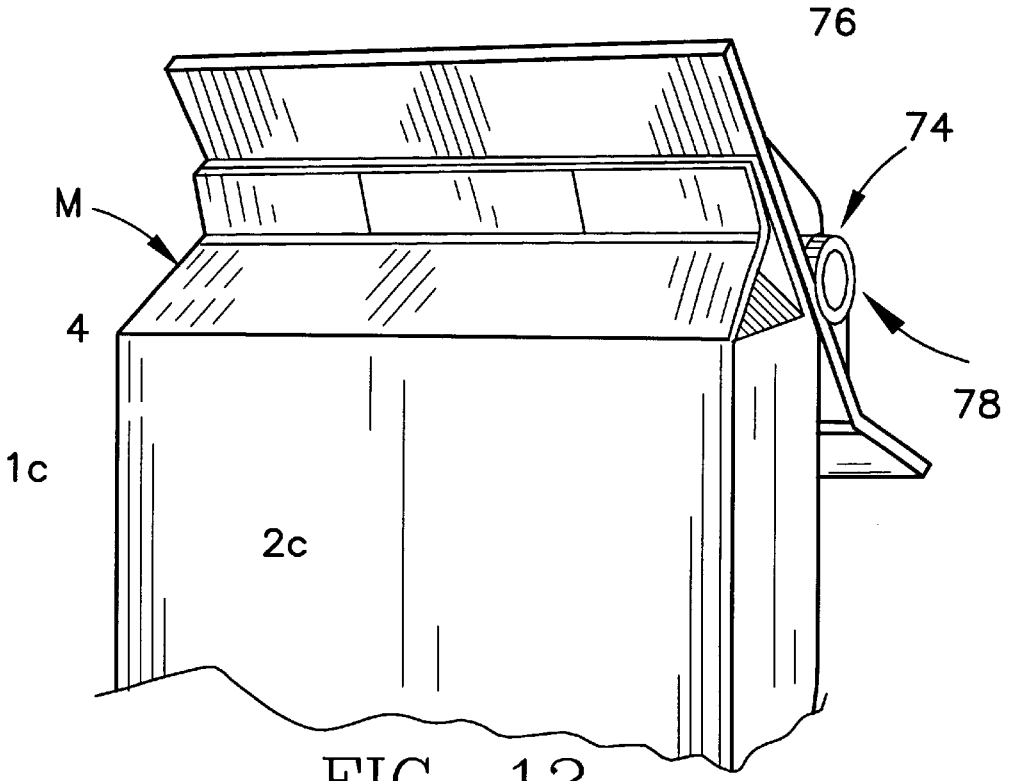
FIG. 12 is a fragmentary perspective view of the exemplary carton bottom after the panels have been inwardly over folded, with the carton engaged with the guide plate of the sealing section.
Figure 13:
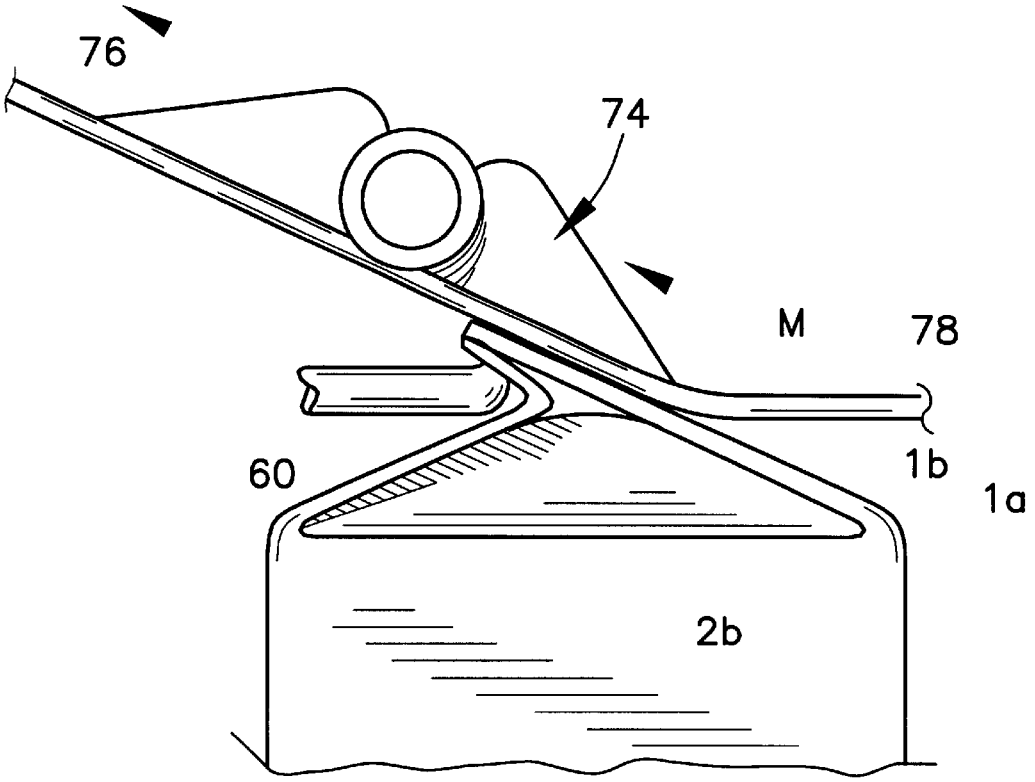
FIG. 13 is a side view of the carton, illustrating the overfolded carton bottom, as it progresses into engagement with the guide plate.

As shown in FIG. 4, a carton C is first rotated to the folding mechanism 40. The pre-folding members 54, 56 engage corresponding bottom panels 1*d*, 1*b*, preferably in the center of each of the panels in order to begin folding the bottom panels 1*b,d* inward. The diagonal score lines 7*a–d* provide direction for the inward folding of panels 1*b,d*. Referring now to FIG. 5, the final folding members 58, 60 engage bottom panel 1*c* in an overlapping manner. The final folding members 58, 60 fold bottom panel 1*c* toward bottom panel 1*a*. Bottom panel 1*c* will be folded over bottom panels 1*b,d,* and bottom panel 1*d* will be folded over part of bottom panel 1*c*. The sixth panel 4 is folded over bottom panel 1*c*, however, bottom panel 1*a* is folded over the sixth panel 4. This is the over-folded carton bottom M configuration FIGS. 12–13 illustrate the guide plate 74 engaging bottom panel 1*c* and pressing it downward toward the other, already folded bottom panels 1*b–d*. The guide plate 74 is fixed, and engages the carton C as it is rotated on the mandrel turret 28. The rotational movement of the turret 28 thus engages the carton bottom M with the guide plate 74. As best seen in FIG. 13, the guide plate 74 includes a leading, angled portion 76 and a flat, relatively planar compression portion 78. The leading portion 76 first engages the bottom panels 1*a–d*. Consequently, as the carton C is rotated by the mandrel turret 28, the bottom panels 1*a–d* are further engaged and compressed downwardly by the compression portion 78. The bottom panels 1*a–d* are thus essentially folded and ready for sealing once engaged with the compression portion 78.

Subsequent to the guide plate 74 is the sealing plate 80 which seals the bottom panels 1*a–d* together. The sealing plate 80 presses the folded bottom panels 1*a–d* against a mandrel plate 82. The sealing plate 80 presses against the bottom panels 1*a–d* for a predetermined period of time to effect a proper bottom seal for the carton C. The carton C is then rotated to the discharge station 44 for placement on the conveyor 22.

It will be recognized by those skilled in the art that the novel folding mechanism 40 of the present invention provides a carton bottom M that is substantially folded prior to having the bottom panels l*a–d* sealed together. This is quite unlike prior devices in which the bottom panels are substantially only partially folded prior to sealing.

Figure 14:
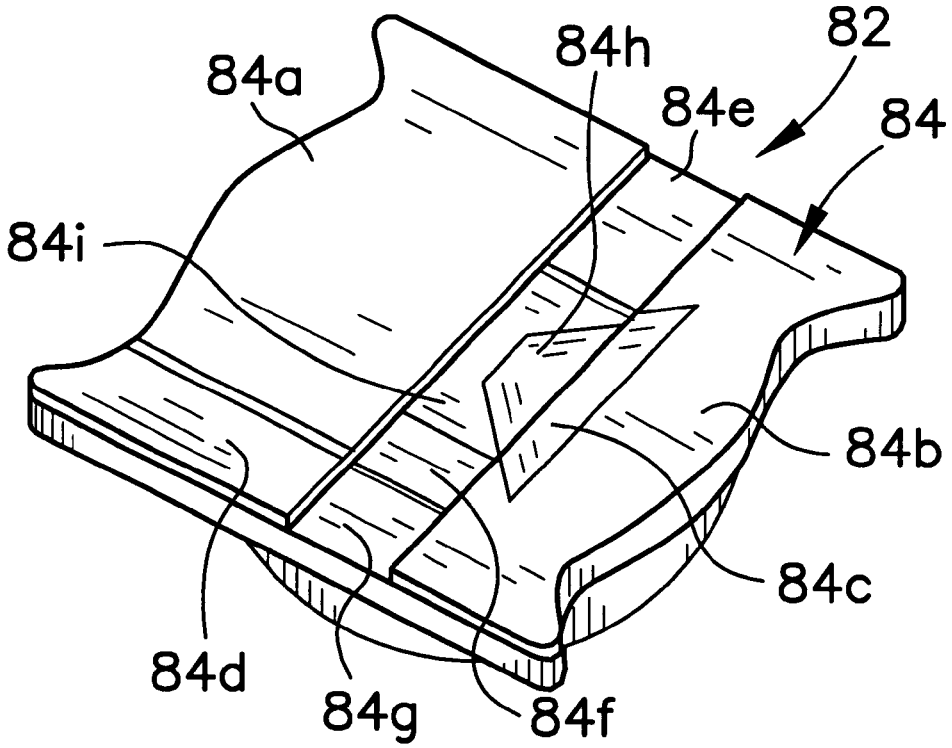
FIG. 14 is a perspective view of an exemplary mandrel plate disposed on a mandrel on which the carton is carried during the folding and sealing operation, and against which the inner surface of the carton bottom is engaged for sealing the bottom panels.

Referring to FIG. 14, the mandrel plate 82 has an unique engagement surface 84 for sealing an overfolded bottom, such as that that may be used for HAAD products. The engagement surface 84 has several recesses of varying depths to allow for proper sealing of the bottom panels 1*a–d*. Due to the numerous layers, and material content of the bottom M of an overfolded bottom carton C, the engagement surface 84 is configured to accommodate these different material thicknesses for different portions of the overfolded carton bottom M. First and second planar areas 84*a,b* are flat, and form a "reference" or "baseline" for the other areas of the engagement surface 84. A first elevated area 84*c* is raised, thus projecting outwardly from the second planar surface 84*b*. A first side recess 84*d* has a depth below the first and second planar surfaces 84*a,b*. First and second center recess areas 84*e,f* have a depth below that of the first side recess area 84*d*. A second side recess area 84*g* has a depth below that of the first and second center recess areas 84*e,f*. A first middle recess area 84*h* has a depth below that of the second side recess area 84*g*. A second middle recess area 84*i* has the greatest depth which is below that of the first middle recess area 84*h*.

Figure 15:
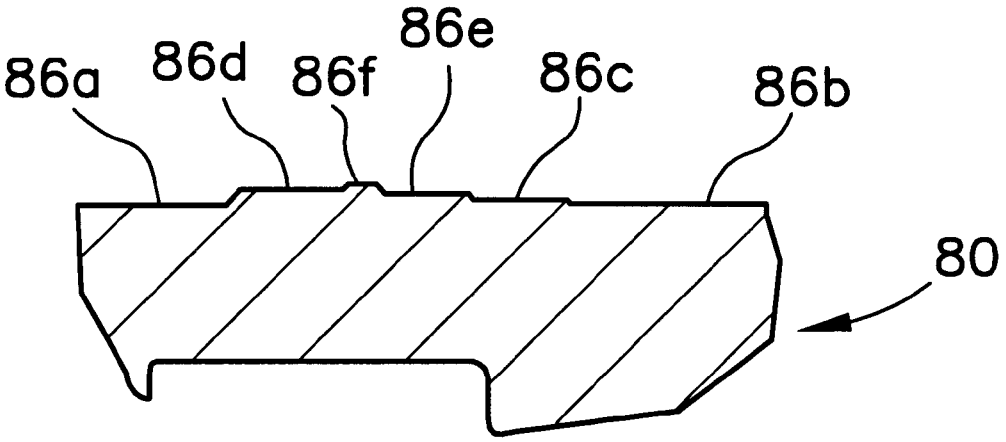
FIG. 15 is a partial cross-sectional view of an exemplary sealing plate that is engaged against the outer surface of the carton bottom for sealing the carton bottom.

As shown in FIG. 15, the sealing plate 80 has several elevations that correspond to the recesses 84*a–i* of the mandrel plate 82 to allow for mating between the mandrel plate 82 and the sealing plate 80 during the sealing operation. The sealing plate 80 has first and second planar areas 86*a,b* and a first elevated area 86*c* that has a height that is greater than the height of the first and second planar areas 86*a,b*. The sealing plate 80 has second and third elevated areas 86*d,e* that have respective heights that are greater than that of the first elevated area 86*a*. The sealing plate 80 has a central elevated area 86*f* that has the greatest height of the sealing plate 80. Thus, those skilled in the art will recognize that the elevated surface areas 86*a–f* of the sealing plate 80 engage the recess areas 84*a–i* of the mandrel plate 82 when the bottom panels 1*a–d* are folded between the plates 80, 82 and to effect a tight bottom seal on the overfolded bottom carton C. Those skilled in the art will also recognize that variations on the location and depths or elevations of the surfaces of the plates and are well within the scope and spirit of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bottom forming apparatus for a packaging machine, the bottom forming apparatus configured to form and seal a bottom of a carton of a series of cartons being processed on the packaging machine, each carton including a plurality of carton bottom panels configured for infolding and sealing to form a sealed carton bottom the bottom forming apparatus comprising:

a mandrel turret having a plurality of mandrels projecting outwardly therefrom, the mandrel turret rotating about a fixed axis;

a sealing station disposed at a fixed position relative to the rotation of the mandrel turret, the sealing station adapted to receive each of the mandrels having a carton thereon, the sealing station including a guide plate and first and second rotatable spindles, each spindle having a pre-folding member and a final folding member extending therefrom, each final folding member being an elongated rod having a straight portion and an arcuate portion, the straight portion being adjacent the spindle and the arcuate portion extending from the straight portion, each of the pre-folding members and final folding members defining a rotational path, the rotational paths being parallel to and spaced from one another, wherein a carton is advanced to the sealing station with the plurality of bottom panels substantially unfolded, and wherein the pre-folding members engage the plurality of carton bottom panels and fold the bottom panels inwardly to urge the panels into a folded condition.

2. The bottom forming apparatus in accordance with claim 1 wherein the guide plate is disposed to engage the bottom of a carton subsequent to folding by the final folding members to further urge the panels into a folded condition.

3. The bottom forming apparatus in accordance with claim 1 wherein each pre-folding member is an elongated rod projecting from its respective spindle.

4. The bottom forming apparatus in accordance with claim 1 wherein each final folding member is an elongated rod projecting from its respective spindle and wherein each final folding member extends from its respective spindle at a predetermined angle relative to its respective pre-folding member.

5. The bottom forming apparatus in accordance with claim 1 wherein the guide plate has an angled portion and a substantially flat portion, the angled portion being proximal to the carton coming into engagement therewith.

6. The bottom forming apparatus in accordance with claim 1 further comprising a sealing plate disposed subsequent to the guide plate and a mandrel plate disposed on each of the mandrels, wherein the plurality of folded carton bottom panels is compressed between the sealing plate and the mandrel plate.

7. The bottom forming apparatus in accordance with claim 6 including a heating station disposed prior to the sealing station relative to the rotation of the mandrel turret, a discharge station disposed subsequent to the sealing station relative to the rotation of the mandrel turret, and an infeed station disposed prior to the heating station relative to the rotation of the mandrel turret.

8. The bottom forming apparatus in accordance with claim 7 further comprising a pre-folding station disposed subsequent to the infeed station relative to the rotation of the mandrel turret.

9. The bottom forming apparatus in accordance with claim 6 wherein each of the mandrel plates has a plurality of flat surface areas and a plurality of recess areas, the plurality of recess areas having predetermined depths.

10. The bottom forming apparatus in accordance with claim 9 wherein the sealing plate has a plurality of projecting areas corresponding to the plurality of recess areas of each of the mandrel plates, wherein the sealing plate engages each of the mandrel plates, with the plurality of folded bottom panels therebetween, during forming of the bottom of the carton.

11. A method for forming a sealed bottom of a carton on a packaging machine, the sealed carton bottom being formed from a plurality of carton bottom panels, the method comprising the steps of:

providing a bottom forming apparatus for a packaging machine, the bottom forming apparatus configured to form and seal a bottom of a carton of a series of cartons being processed on the packaging machine, each carton including a plurality of carton bottom panels configured for infolding and sealing to form a sealed carton bottom;

providing a mandrel turret having a plurality of mandrels projecting outwardly therefrom, the mandrel turret rotating about a fixed axis;

placing an erected carton on one of the mandrels;

providing a sealing station disposed at a fixed position relative to the rotation of the mandrel turret, the sealing station adapted to receive each of the mandrels having a carton thereon, the sealing station including a guide plate and first and second rotatable spindles, each spindle having a pre-folding member and a final folding member extending therefrom, each final folding member being an elongated rod, or final folding assembly, having a straight portion and an arcuate portion, the straight portion being adjacent the spindle and the arcuate portion extending from the straight portion, each of the pre-folding members and final folding members defining a rotational path, the rotational paths being parallel to and spaced from one another;

pre-folding the plurality of bottom panels at a sealing station to form a plurality of pre-folded bottom panels;

contacting the bottom panels with a pair of final folding assemblies, to final fold the plurality of pre-folded bottom panels subsequent to the pre-folding step at the sealing station, to form a plurality of final folded carton bottom panels, the arcuate portion of the final folding assembly configured for first contacting the bottom panels;

guiding the final folded carton bottom panels to a sealing plate at the sealing station; and sealing the folded bottom panels to form the sealed carton bottom.

12. The method in accordance with claim 11 including the step of heating the bottom panels at a heating station prior to the step of pre-folding the plurality of carton bottom panels.

13. A method for forming a sealed bottom of a carton on a packaging machine, the sealed carton bottom being formed from a plurality of carton bottom panels, the method comprising the steps of:

placing an erected carton on a mandrel of a mandrel turret, the mandrel turret rotating about a fixed axis;

heating the bottom panels at a heating station;

pre-folding the plurality of bottom panels at a sealing station to form a plurality of pre-folded bottom panels, including rotating a pair of spindles each spindle moving a pre-folding member into engagement with the carton bottom panels;

contacting the bottom panels with a pair of final folding assemblies, to final fold the plurality of pre-folded bottom panels subsequent to the pre-folding step at the sealing station, including rotating the pair of spindles, each spindle also moving a final folding member thereon, into engagement with the carton bottom panels, to form a plurality of final folded carton bottom panels, each final folding assembling having a straight portion and an arcuate portion extending from the straight portion, the arcuate portion configured for first contacting the bottom panels, the pre-folding members and final folding members each defining a rotational path, the rotational paths being parallel to and spaced from one another;

guiding the final folded carton bottom panels to a sealing plate at the sealing station; and sealing the folded bottom panels to form the sealed carton bottom.

14. The method in accordance with claim 13 including rotating the mandrel turret about the fixed axis during the pre-folding and final folding steps.

15. A packaging machine for forming, filling and sealing a series of cartons, each carton including a plurality of carton bottom panels configured for infolding and sealing to form a sealed carton bottom, the packaging machine comprising:

a mandrel turret having a plurality of mandrels projecting outward therefrom, the mandrel turret rotating about a fixed axis and configured to receive and advance the series of carton from a station to a next subsequent station; and a bottom forming station for forming the sealed carton bottom on the series of carton, the bottom forming station including a sealing station disposed about the rotation of the mandrel turret, the sealing station configured to receive each of the mandrels having a carton thereon and infolding the carton bottom panels, the sealing station having a guide plate and first and second rotating spindles, each spindle having a pre-folding member and a final folding member extending therefrom, each final folding member having a straight portion adjacent the spindle and an arcuate portion extending from the straight portion, each pre-folding member and final folding member defining a rotational path, the rotational paths being parallel to and spaced from one another;

a filling station disposed subsequent to the bottom forming station; and a top sealing station disposed subsequent to the filling station.

16. The packaging machine in accordance with claim 15 including a sealing plate disposed subsequent to the guide plate relative to advancement of a carton through the packaging machine.

17. The packaging machine in accordance with claim 16 including a mandrel plate disposed on each of the mandrels.

18. The packaging machine in accordance with claim 17 wherein each mandrel plate has a plurality of flat surface areas and a plurality of recess areas, the plurality of recess areas each having a predetermined depth.

19. The packaging machine in accordance with claim 18 wherein the sealing plate has a plurality of projecting areas corresponding to the plurality of recess areas of each mandrel plate, wherein the sealing plate engages each of the mandrel plates, with the carton bottom panels compressed therebetween, during forming of the sealed carton bottom.

20. The packaging machine in accordance with claim 15 further including a sterilization station disposed prior to the filling station.

21. The packaging machine in accordance with claim 20 wherein the series of cartons is processed to produce a high acid ambient distribution product.

* * * * *